US010107289B2

(12) United States Patent
Kovacevic et al.

(10) Patent No.: US 10,107,289 B2
(45) Date of Patent: Oct. 23, 2018

(54) BEARING INSERT HAVING FLATTENED PORTION AND FLUID MACHINE HAVING THE SAME

(75) Inventors: Ahmed Kovacevic, Barnet (GB); Nsikan Udo, Glasgow (GB)

(73) Assignee: HOWDEN COMPRESSORS LIMITED, Glasgow, Strathclyyde (GB)

( * ) Notice: Subject to any disclaimer, the term of this patent is extended or adjusted under 35 U.S.C. 154(b) by 0 days.

(21) Appl. No.: 14/115,559

(22) PCT Filed: May 3, 2012

(86) PCT No.: PCT/GB2012/050967

§ 371 (c)(1),
(2), (4) Date: Nov. 4, 2013

(87) PCT Pub. No.: WO2012/150456

PCT Pub. Date: Nov. 8, 2012

(65) Prior Publication Data

US 2014/0322059 A1 Oct. 30, 2014

(30) Foreign Application Priority Data

May 5, 2011 (GB) ..... 1107451.5

(51) Int. Cl.
*F04C 29/00* (2006.01)
*F04C 18/10* (2006.01)
(Continued)

(52) U.S. Cl.
CPC ..... *F04C 29/005* (2013.01); *F04C 18/082* (2013.01); *F04C 18/16* (2013.01); *F04C 29/0021* (2013.01); *F04C 2240/56* (2013.01)

(58) Field of Classification Search
CPC .... F04C 18/082; F04C 18/16; F04C 2240/56; F04C 29/0021; F04C 29/005;
(Continued)

(56) References Cited

U.S. PATENT DOCUMENTS 4,076,468 A * 2/1978 Persson ..... F04C 18/16 418/201.2
4,638,570 A * 1/1987 Soeters, Jr. ..... F04C 18/126 33/562
(Continued)

FOREIGN PATENT DOCUMENTS

EP 1967734 A1 9/2008
SU 964239 A 7/1982

OTHER PUBLICATIONS

International Search Report and Written Opinion, dated Jun. 27, 2013 for PCT/GB2012/050967 filed May 3, 2012.
(Continued)

*Primary Examiner* — Mark Laurenzi
*Assistant Examiner* — Paul Thiede
(74) *Attorney, Agent, or Firm* — Edell, Shapiro & Finnan, LLC

(57) ABSTRACT

The present disclosure relates to fluid machines, especially compressors, more especially screw compressors. More particularly the present disclosure describes a fluid machine comprising at least one rotor (64), the rotor including a rotor drive shaft (68) extending from the rotor, a housing in which is mounted the rotor, and at least one bearing insert (74) which mounts around the rotor drive shaft at a first end of the rotor and which includes at least one bearing (114) within it and attaches to the housing. The present disclosure also describes bearing inserts suitable for use on such fluid machines.

20 Claims, 8 Drawing Sheets

(51) Int. Cl.
*F04C 18/08* (2006.01)
*F04C 18/16* (2006.01)

(58) Field of Classification Search
CPC ..... F01C 11/002; F01C 1/082; F01C 1/16; F01C 21/003; F05C 2201/0409; F05C 2201/90; F05C 2203/0843
USPC ..... 418/206.7, 201.2; 417/410.4
See application file for complete search history.

(56) References Cited

U.S. PATENT DOCUMENTS

| | | | | |
|---|---|---|---|---|
| 5,393,209 | A | 2/1995 | Mohr et al. | |
| 2004/0258551 | A1 | 12/2004 | Yoghimura | |
| 2005/0089414 | A1* | 4/2005 | Ohman ..... | F04B 35/045 417/410.4 |

OTHER PUBLICATIONS

Communication Pursuant to Article 94(3) for European patent application No. 12 722 800.5-1616 dated Nov. 9, 2017.
Examiner's Report for Canadian Patent Application 2,835,082 dated May 23, 2018, 4 pages.

* cited by examiner

BEARING INSERT HAVING FLATTENED PORTION AND FLUID MACHINE HAVING THE SAME

FIELD OF THE INVENTION

The present invention relates to fluid machines, especially compressors, more especially screw compressors.

BACKGROUND OF THE INVENTION

Screw compressors will usually comprise two helical compressor rotors which closely mesh within a compressor housing. There is a female and a male rotor, which are mounted with the spirals of their respective helices orientated in opposite directions. The rotors are driven and as they rotate, fluid is trapped in the space between the rotors and the housing. This enables the fluid to be compressed by the action of the rotors.

The casings of such screw compressors generally comprise three separate sections: a main central housing, an inlet housing and an outlet housing. In some case, two of these components may be combined into one contiguous piece, such as the inlet casing and the main casing. All three of these are structural elements i.e. they bear load transmitted through bearings.

The inlet and outlet housings will have mounts for the rotor shafts, with the main bodies of the rotors mounted within conjoined rotor chambers. Since the rotors may rotate at high speed and require precise tolerances to enable correct operation, thrust and radial bearings are used to maintain correct relative positioning.

Compressing the gas creates a pressure load that is borne by the rotors.

Compressing fluids creates heat and this heat causes expansion of the materials used to manufacture the housings and rotors. Since they may be formed from different materials, are different shapes and are exposed to varying temperatures, the rotors and the casings will not expand uniformly, and hence a thermal load is created by the rotors expanding longitudinally against the mounts.

The three housings are connected to one another usually be arrangements of flanges and bolts, and the loads acting upon the system must be resisted by these arrangements.

SUMMARY OF THE INVENTION

According to a first aspect of the present invention there is provided a fluid machine comprising at least one rotor, the rotor including a rotor drive shaft extending from the rotor, a housing in which is mounted the rotor, and at least one bearing insert which mounts around the rotor drive shaft at a first end of the rotor and which includes at least one bearing within it and attaches to the housing.

The term "fluid machine" will be understood to include, without limitation, pumps, compressors, turbines and expanders.

The rotor will have lobes or blades projecting from the rotor drive shaft to a maximum diameter, and the bearing inserts may have a dominant dimension, measured substantially perpendicularly to a main axis of the rotor shaft, that is substantially the same as said maximum diameter.

The fluid machine may be a screw compressor, the rotor being a screw type with helical lobes surrounding a rotor drive shaft, and the dimension of the bearing insert is substantially the same as that of the maximum helical lobe diameter.

The fluid machine may include two meshing rotors.

The fluid machine may include two bearing inserts. The bearing inserts may be joined along a sidewall.

The bearing insert may be substantially cylindrical. The bearing insert may have a flattened portion on a cylindrical sidewall for mating with another bearing insert.

The bearing insert may include a flange for attaching the bearing insert to the housing. The bearing insert may include a fluid machine port formed in it. This may be in the form of an external indentation on one or more exterior sidewalls. Two or more bearing inserts may have cooperating indentations to form a fluid machine port. This port may be a suction, discharge or other The bearing insert may include at least one thrust bearing and at least one radial bearing within it.

The rotors may have bearing inserts on both first and second ends.

The rotors may be further mounted within the housing at an end opposite the bearing insert with an axial biasing device, which may be a balance piston. A bearing may be provided adjacent the axial biasing device.

According to a second aspect of the present invention there is provided a bearing insert suitable for use with a fluid machine, comprising a substantially tubular body with a central bore, the central bore including at least one internally mounted bearing, with a bearing surface exposed within the central bore.

The bearing insert may include an attachment flange around a first end of the tubular body.

The bearing insert may have a flattened portion on a cylindrical sidewall for mating with another bearing insert.

The bearing insert may include a port formed in it. This may be in the form of an external indentation on an exterior sidewall. Two or more bearing inserts may have cooperating indentations to form a port. This may be a high pressure port.

The bearing insert may include at least one thrust bearing and at least one radial bearing within it.

BRIEF DESCRIPTION OF THE DRAWINGS

An example of the present invention will now be described, by way of example only, with reference to the following drawings, in which.

Figure 1:
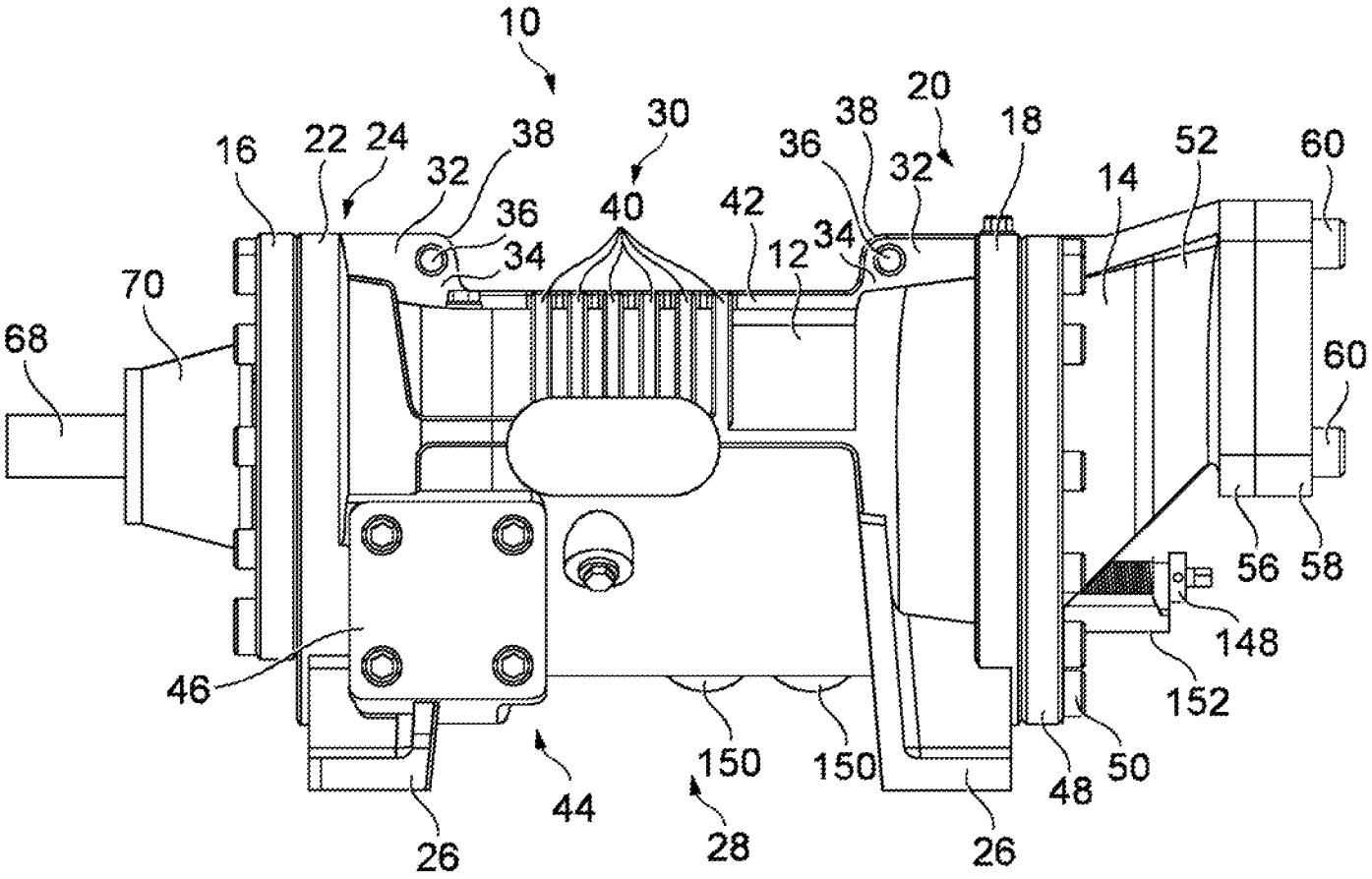
FIG. 1 is a side elevation of a fluid machine, namely a screw compressor, according to the present invention.
Figure 2:
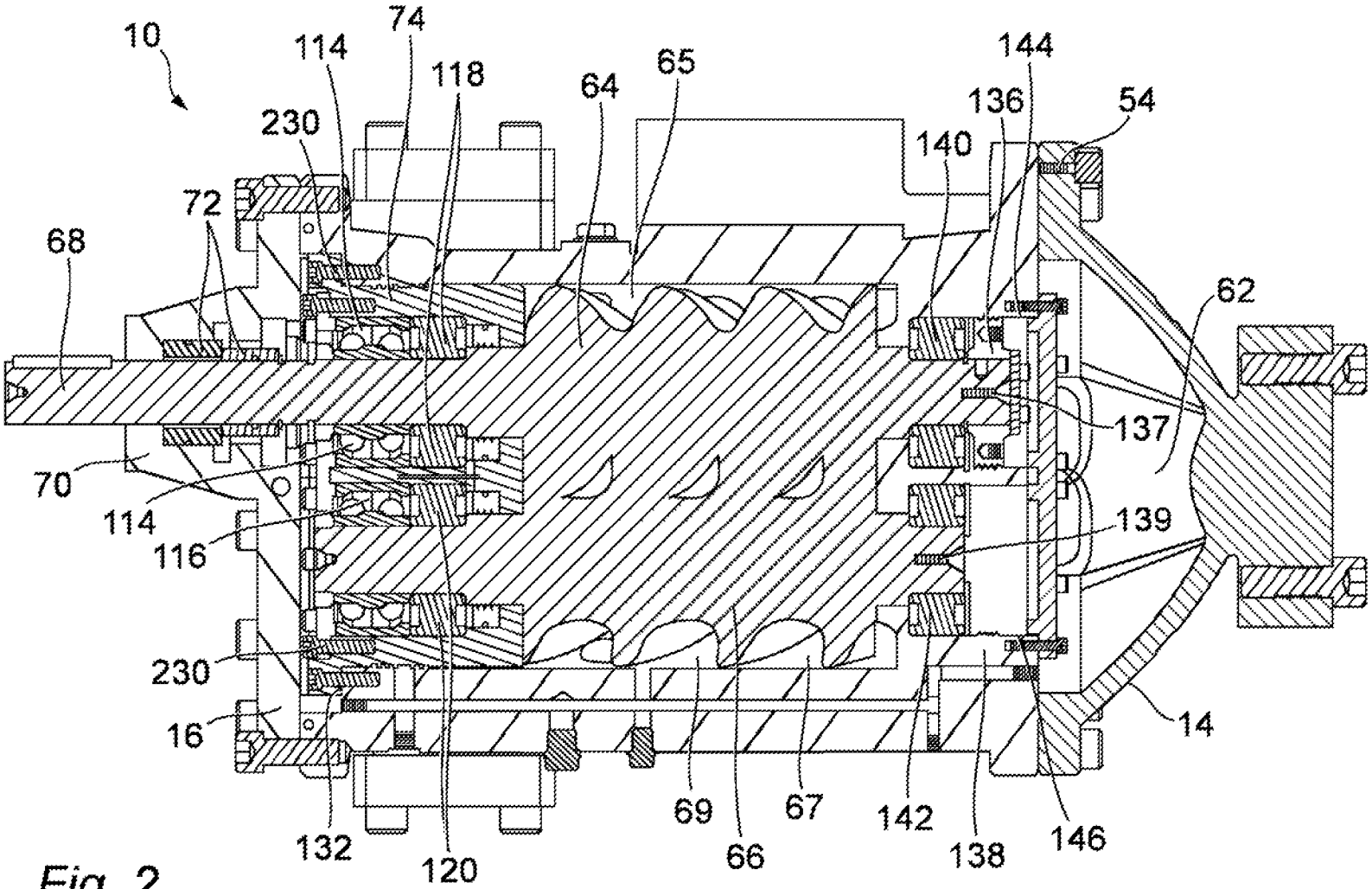
FIG. 2 is a plan sectional view of the compressor of FIG. 1.
Figure 3:
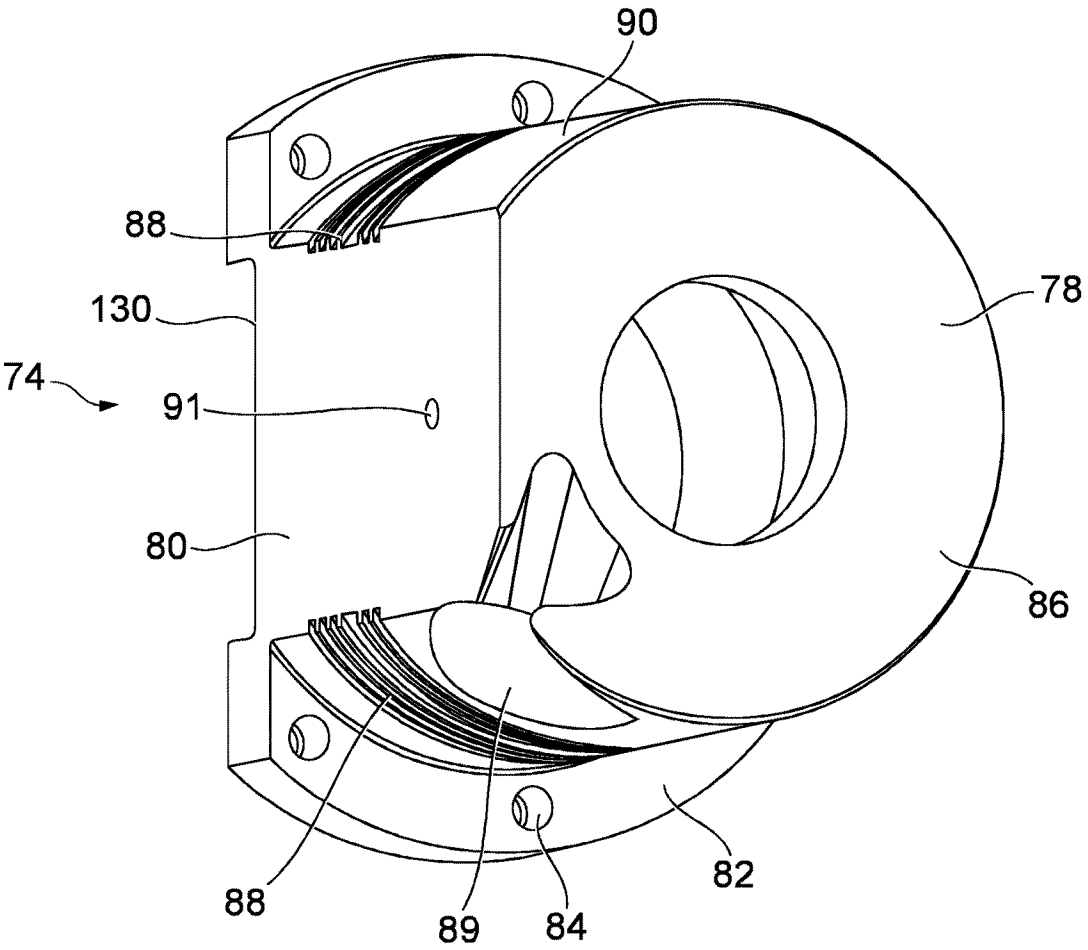
FIG. 3 is a perspective view of a male bearing insert of the compressor of FIG. 1.
Figure 4:
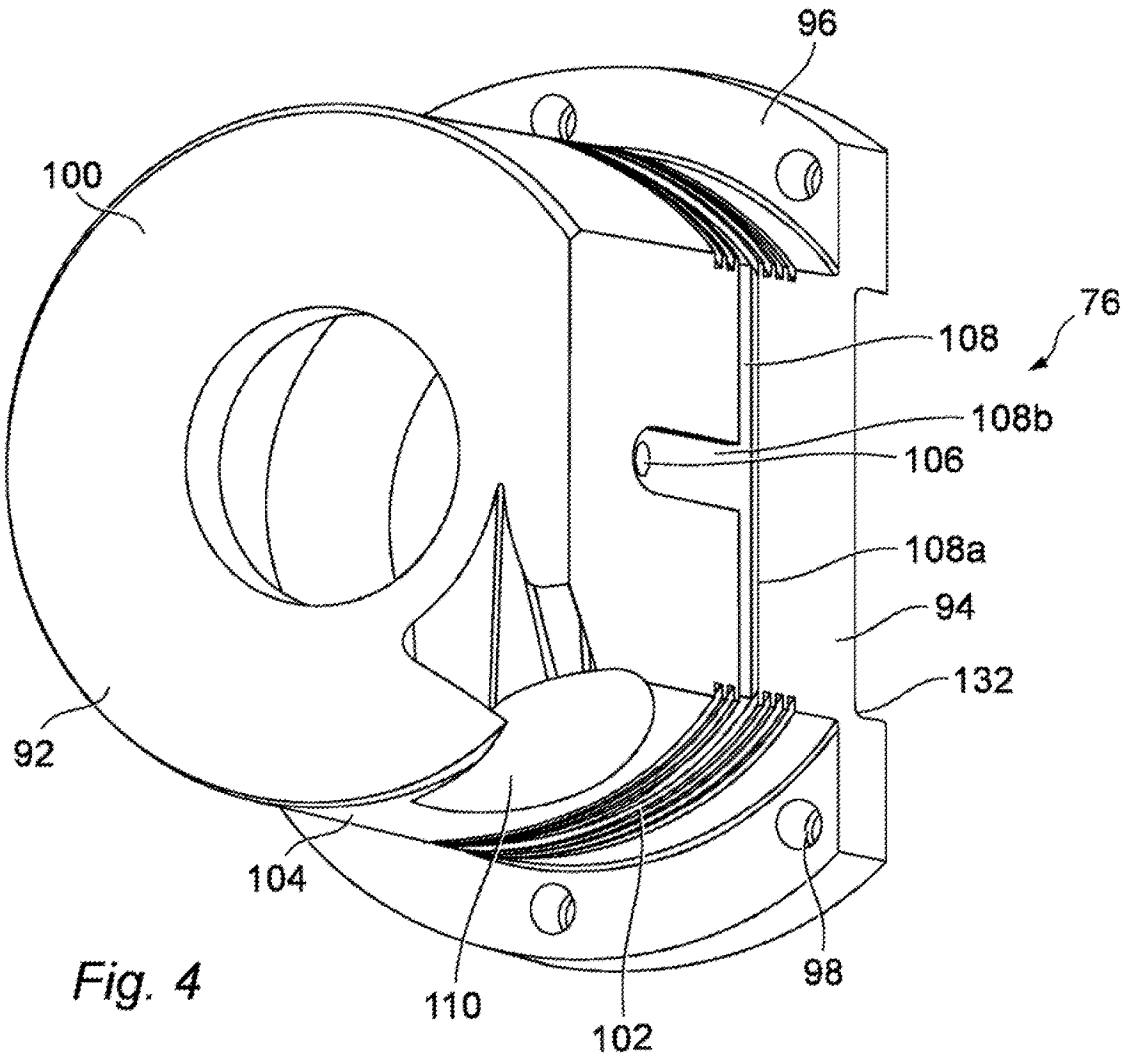
FIG. 4 is a perspective view of a female bearing insert of the compressor of FIG. 1.

A screw compressor 10 is shown in FIG. 1. It comprises a housing 12, an inlet cover 14 and an outlet cover 16. The housing 12 is a generally cylindrical shape, with a first flange 18 at the inlet end 20 and a second flange 22 at the outlet end 24. Mounting feet 26 project from a lower surface 28 of the housing 12 and are adjacent inlet end 20 and outlet end 24. Approximately diametrically opposite the mounting feet 26, on an upper surface 30 of the housing 12 and adjacent inlet end 20 and outlet end 24 are mounting lugs 32. The mounting lugs 32 comprise a radially projecting plate 34, the plane of the plate 34 being substantially parallel to a horizontal axis of the screw compressor 10 cylindrical housing 12. In each plate 34 is an aperture 36 adjacent a chamfered corner 38 of the plate 34, the chamfered corner 38 being disposed axially inboard and radially outward of the housing 12.

Located at the approximate axial midpoint of the housing 12 around the upper surface 30, are radial strengthening ribs. Six strengthening ribs 40 are provided on the present embodiment. The strengthening ribs 40 form a contiguous arrangement with an axial strengthening spine 42, the spine 42 also being contiguous with the mounting lugs 32.

An outlet port 44 projects radially from the housing 12 adjacent the lower surface 28. The outlet port 44 has a substantially square outlet plate cover 46 attached to it.

The inlet cover 14 includes an inlet cover flange 48 which attaches to the first flange 18 with mechanical fasteners i.e. nuts 50 which attach to threaded bolts 54 that project from the first flange 18. A substantially offset frustum-shaped body 52 extends from the inlet cover flange 48, and is offset towards the upper surface 30 of the housing 12. A mounting flange 56 with attached cover 58 is disposed at the distal end of the inlet cover 14 from the inlet cover flange 48. Mechanical fasteners in the form of threaded bolts 60 attach mounting flange 56 to cover 58.

An inlet duct 62 is defined within the inlet cover 14 and is in the form of a largely conical channel, which allows for fluid communication between a bore (not shown) at the centre of the mounting flange 56 and the internal components of the compressor 10.

A male rotor 64 and female rotor 66 are provided within the housing 12. The male rotor 64 and female rotor 66 are meshed, similar to prior art compressors. The male rotor 64 and female rotor 66 are housed within adjoined cylindrical cavities 65, 67 within the housing 12 that overlap to form a conjoined cavity 69 with a "figure eight" cross-section. The sidewalls of the cavity 69 are very close in diameter to the outer diameter of each rotor 64,66 such that there is minimal clearance, but the rotors 64,66 are not impeded from rotating.

A drive shaft 68 extends from the male rotor 64 and projects from the outlet cover 16 of the compressor 10. This will be driven by a rotational motor (not shown), which may be electrical or mechanical or some other type, to power the compressor 10. This projects through outlet cover 16, which is a substantially circular plate member, with circumferential bores to enable its attachment to the housing 12 via second flange 22. On the surface of the outlet cover 16 opposite the housing 12 from which the drive shaft 68 projects, and disposed around the base of the drive shaft 68 is a shaft cover 70. The shaft cover 70 is a substantially frusto-conical shape, with the greater diameter end abutting the outlet cover 16. Shaft bearings 72 are provided within the shaft cover 70 and around the drive shaft 68.

A male bearing insert 74 is provided around the base of the male rotor 64. The male bearing insert 74 is located adjacent the shaft cover 70 on the inside of the compressor 10.

A female bearing insert 76 is provided around the base of the female rotor 66. Both bearing inserts 74 and 76 are covered by the outlet cover 16 but neither are connected nor abut the outlet cover 16. Consequently, neither rotor 64, 66 is structurally dependent upon the outlet cover 16 nor will act upon it under load.

Male bearing insert 74 comprises a generally tubular main body 78 that is radially truncated to form a planar male mating face 80. A male bearing insert flange 82 is provided around a first end of the male bearing insert 74, the flange 82 also being truncated to form the male mating face 80. The flange 82 is provided with a plurality of flange attachment apertures 84 around its circumference. At a second end of the male bearing insert 74, located distally from the first end, is a male rotor annulus 86. A male insert labyrinth seal 88 is provided adjacent the flange 82, and is disposed on the sidewall 90 of the tubular main body 78. The labyrinth seal 88 intersects the male mating face 80. A male insert attachment aperture 91 is provided on the male mating face 80, located axially towards the male rotor annulus 86, but at the approximate diametric centre of the tubular main body 78 and male mating face 80.

A male outlet port 89 is formed adjacent the male mating face 80 and the male rotor annulus 86. The male outlet port 89 intersects both the male mating face 80 and the male rotor annulus 86 such that fluid flow is permitted through the port 89 from outside male mating face 80 through the tubular main body 78 and out the male rotor annulus 86, towards the male rotor 64.

Female bearing insert 76 comprises a generally tubular main body 92 that is radially truncated to form a generally planar female mating face 94. A female bearing insert flange 96 is provided around a first end of the female bearing insert 76, the flange 96 also being truncated to form the female mating face 94. The flange 96 is provided with a plurality of flange attachment apertures 98 around its circumference. At a second end of the female bearing insert 76, located distally from the first end, is a female rotor annulus 100. A female insert labyrinth seal 102 is provided adjacent the flange 96, and is disposed on the sidewall 104 of the tubular main body 92. The labyrinth seal 102 intersects the female mating face 94.

A female insert attachment aperture 106 is provided on the female mating face 94, located axially towards the female rotor annulus 100, but at the approximate diametric centre of the tubular main body 92 and female mating face 94. The female insert attachment aperture 106 is located within a T-shaped groove 108 formed in the female mating face 94. The T-shaped groove 108 is located with the upper cross groove 108*a* projecting diametrically across the female mating face 94 and in fluid communication with the labyrinth seal 102, and the lower groove 108*b* projecting from the midpoint of the upper cross groove 108*a*, axially along the female mating face 94, but terminating within the confines of the female mating face 94. The female insert attachment aperture 106 is located at the base of the lower groove 108*b*, the base of the lower groove 108*b* having a rounded lower extremity.

A female outlet port 110 is formed adjacent the female mating face 94 and the female rotor annulus 100. The female outlet port 110 intersects both the female mating face 94 and the female rotor annulus 100 such that fluid flow is permitted through the port 110 from outside female mating face 94 through the tubular main body 92 and out the female rotor annulus 100, towards the female rotor 66.

Figure 5:
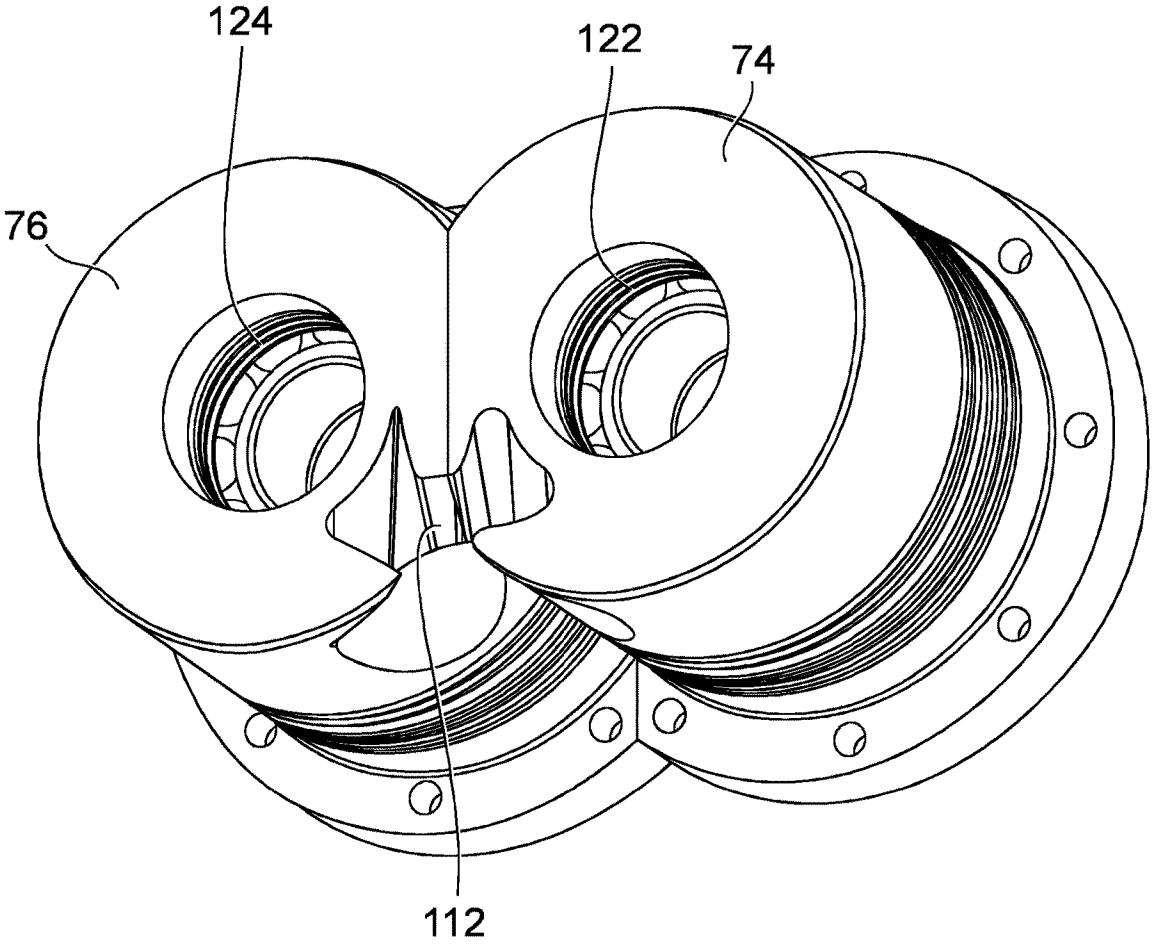
FIG. 5 is a perspective view of the male bearing insert of FIG. 3 attached to the female bearing insert of FIG. 4.

FIG. 5 shows the male bearing insert 74 attached to the female bearing insert 76. The inserts 74,76 are attached along their corresponding mating faces 80,94 with a mechanical fastener (not shown) attaching them via their respective attachment apertures 91,106. This forms a largely contiguous insert arrangement, with a largely "figure eight" cross-section.

The male outlet port 89 and female outlet port 110, having corresponding location on their respective bearing inserts 74, 76, cooperate to form a combined outlet port 112.

Bearings are provided within the bearing inserts 74,76. Two bearings are provided in each bearing insert 74,76 in the present embodiment. Adjacent the first ends and within each bearing insert 74,76 is provided a thrust bearing, respectively numbered 114 (male bearing insert thrust bearing 114) and 116 (female bearing insert thrust bearing 116). The thrust bearings 114,116 are a ball bearing type.

Adjacent the thrust bearings 114,116 and located towards the rotors 64,66 are radial bearings, respectively numbered 118 (male bearing insert radial bearing 118) and 120 (female bearing insert radial bearing 120). The radial bearings 118, 120 are a friction bearing type.

Adjacent the radial bearings 118,120 and located towards the rotors 64,66 are inner labyrinth seals, respectively numbered 122 (male bearing insert inner labyrinth seal 122) and 124 (female bearing insert inner labyrinth seal 122).

Adjacent the thrust bearings 114, 116 are provided removable inner flange rings respectively numbered 126 (male bearing inner flange ring 126) and 128 (female bearing inner flange ring 128). The thrust bearings 114,116, radial bearings 118,120 and inner labyrinth seals 122,124 are held within their respective bearing inserts 74,76 between the rotor annuli 86,100 and the removable inner flange rings 126,128.

The removable inner flange rings 126,128 have a similar cross sections to the bearing inserts themselves, and attach to the ends of the bearing inserts with mechanical fasteners 230 that attach to insert lips 130,132 provided adjacent the flanges 82,96.

The rotors 64,66 are mounted into the bearing insert assembly 74,76 at a first end of both rotors with the rotor annuli 86,100 facing lobes 64*a*,66*a* of the rotors 64,66. The combined outlet port 112 is therefore in direct fluid communication with the rotors 64,66 and rotor lobes 64*a*,66*a*.

Figure 6:
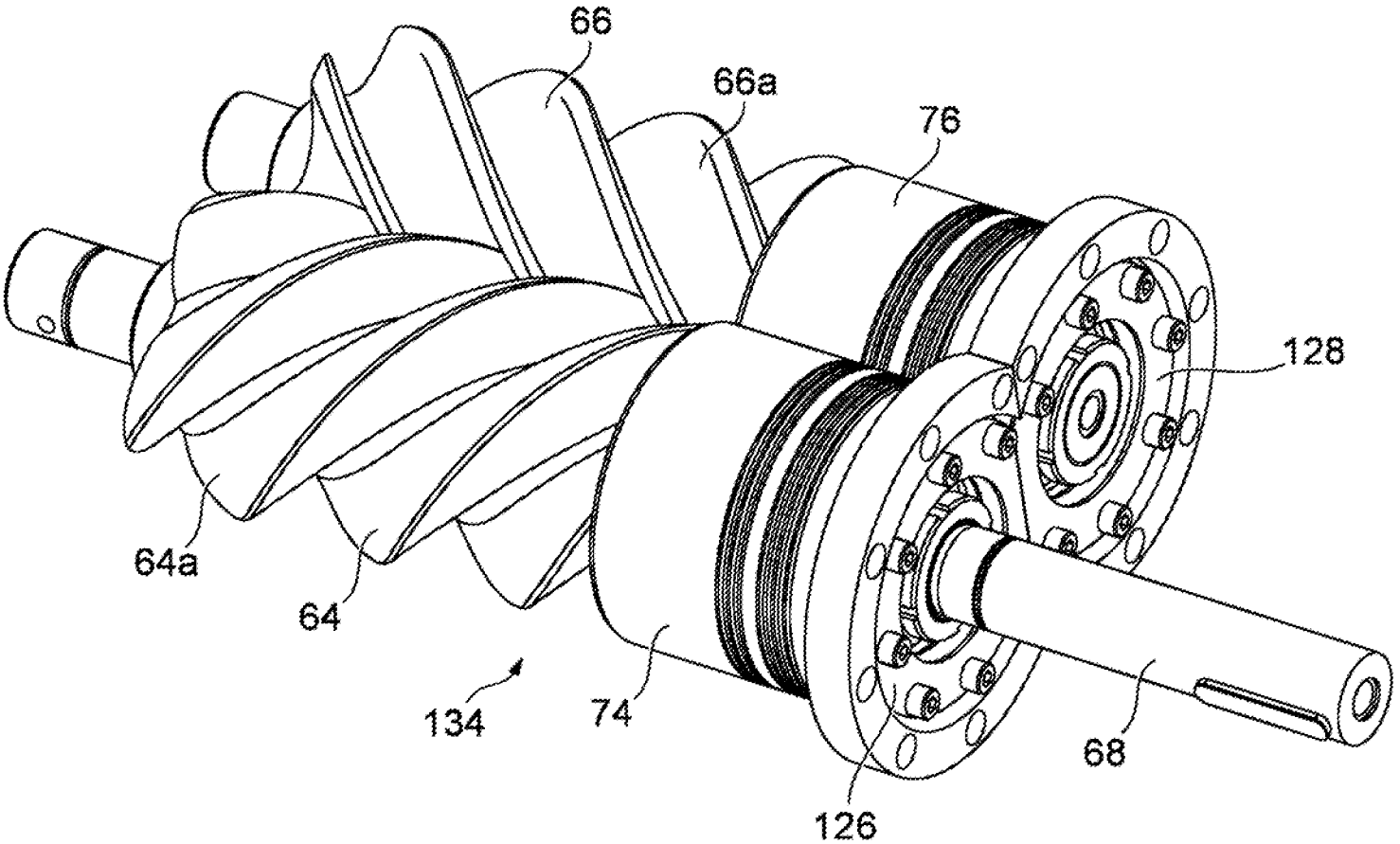
FIG. 6 is a perspective view of the joined bearing inserts of FIG. 5 with male and female rotors inserted.
Figure 7:
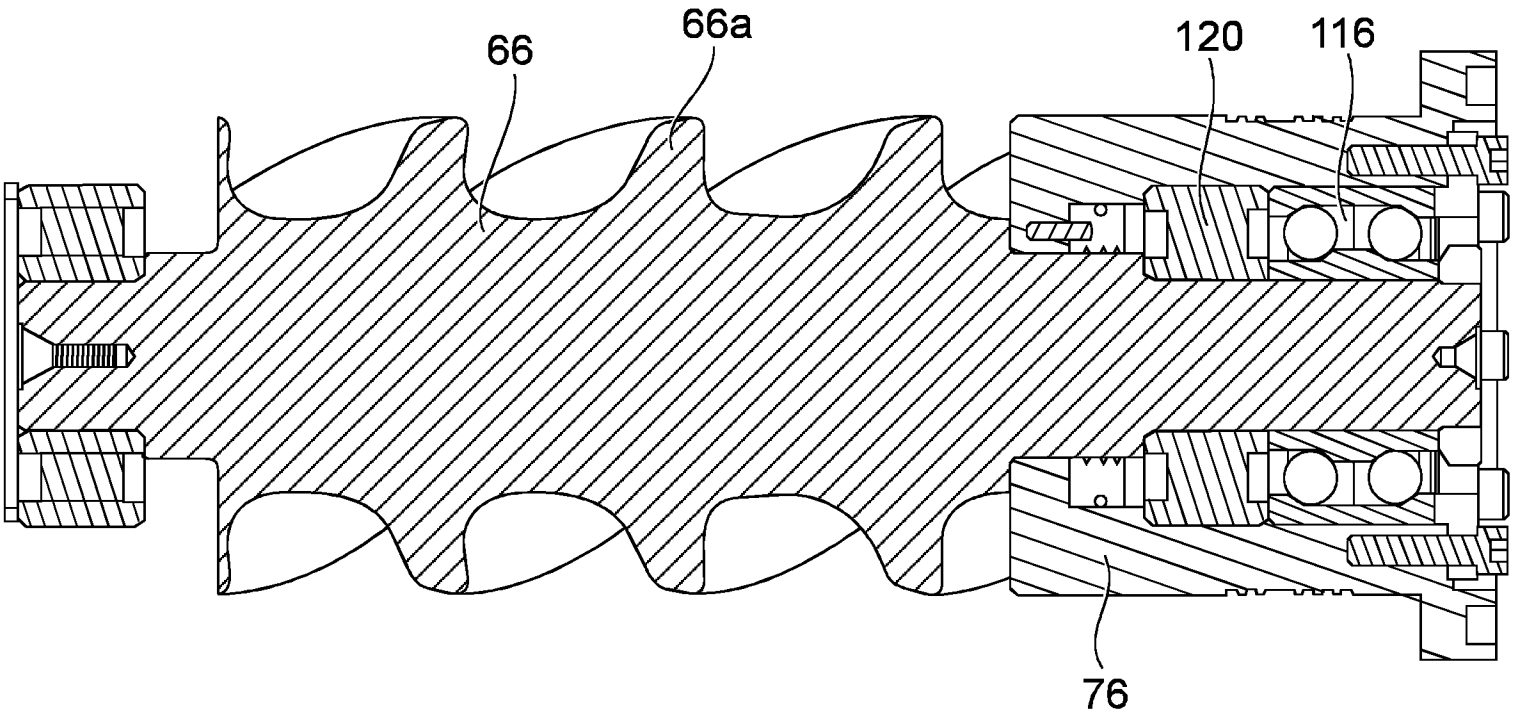
FIG. 7 is a sectional side elevation of the female rotor and bearing insert arrangement of the compressor of FIG. 1.
Figure 8:
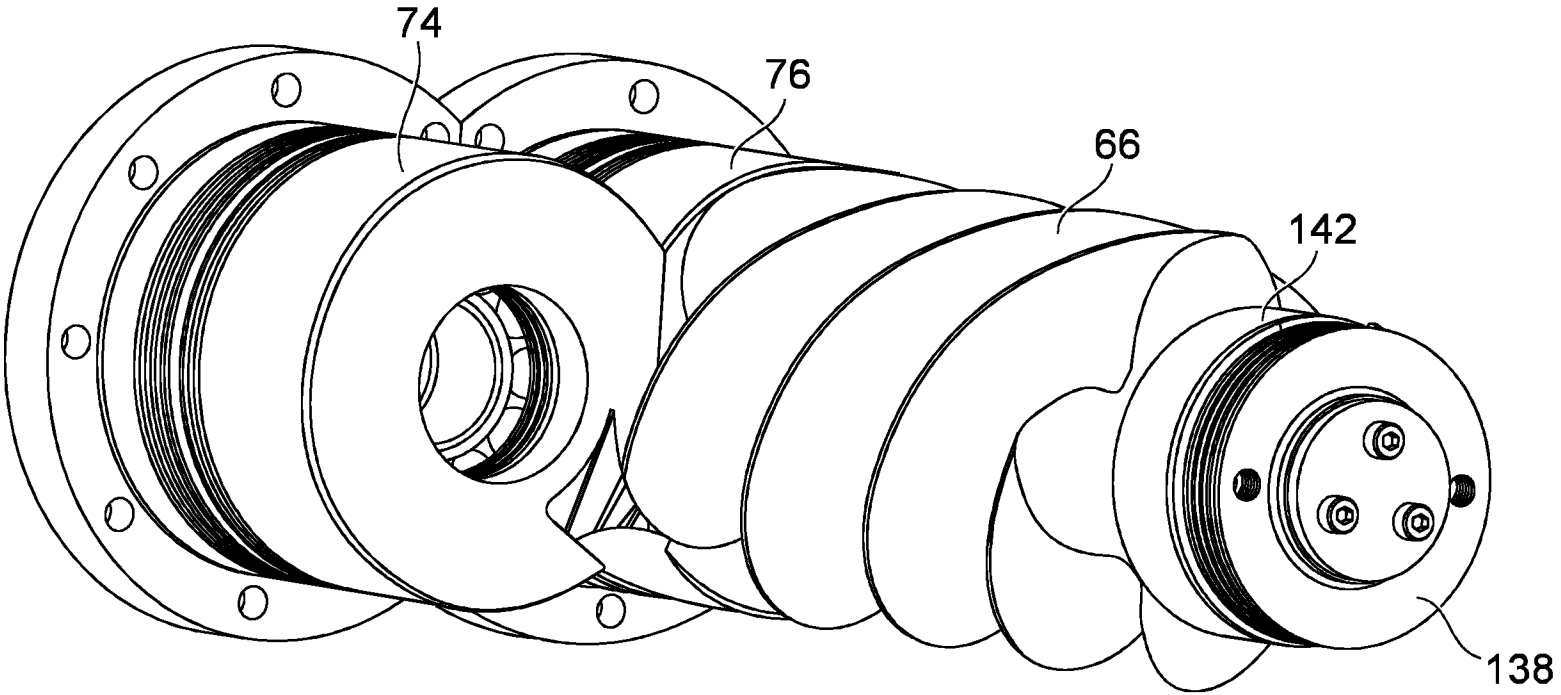
FIG. 8 is a further perspective view of the arrangement of FIG. 6 with the female rotor in transparent section.

The rotors 64,66 and bearing insert assembly 134 (seen in FIG. 6) may then be mounted within the housing 12. The bearing insert assembly 134 is mounted into the conjoined cavity 69 at the outlet end 24. A cavity lip (not shown) co-operable with the bearing insert flanges 82,96 is provided around the entry to the conjoined cavity 69. Mechanical fasteners attach the bearing insert flanges 82,96 to the cavity lip and therefore the housing 12.

Balance pistons 136,138 are mounted on the distal end of the male and female rotors 64,66; that is, the end opposite the bearing inserts 74,76. Mechanical fasteners 137,139 are used to mount the balance pistons 136,138 to the Further balance piston side radial bearings 140,142 are also mounted around the distal end of the male and female rotors 64,66, adjacent the balance pistons 136,138 but inboard of them; that is, between balance pistons 136,138 and rotor lobes 64*a*,66*a*.

The balance pistons 136,138 mount within corresponding sockets 144,146 within each cavity 65,67 at the inlet end 20, ensuring axial alignment of the rotors 64,66 at that end 20 of the housing 12 together with the balance piston side radial bearings 140,142.

On the housing 12 there is also provided a variable Volume Index (VI) control slider valve 148 to control Volume Index and two poppet valves 150 which provide capacity control. The control slider valve includes a manual control mechanism 152 which extends from the inlet end 20 out of the housing 12. The manual control mechanism 152 comprises a slider and threaded rod mechanism, which may be controlled manually or automatically, with a stepper motor (not shown) for example.

In use, an external motor drives the drive shaft 68. This causes the male rotor 64 to rotate within cavity 65 and imparts this rotational motion to female rotor 66 via the respective rotor lobes 64*a*,66*a*.

Fluid is drawn into the interlobe space from the inlet end 20 through the inlet duct 62. As the rotor lobes 64*a*,66*a* mesh fluid is trapped and compressed as it is forced along the rotors 64,66 from inlet end 20 to outlet end 24. Eventually, the interlobe space occupied by the fluid is forced through the combined outlet port 112 formed on the bearing insert assembly 74,76 and exposed to outlet port 44, through which the fluid is discharged.

This process imparts three main loads to the rotors: a drive load from the motor driving the drive shaft; a pressure load from the fluid being compressed in the interlobe spaces and a thermal load as a temperature rise will result from the compression process causing components to expand, including the rotors 64,66.

In prior art machines, these loads would be borne by the main structural components of a three-part casing: a main housing, an inlet housing and an outlet housing.

These loads are now borne by the housing 12 alone, and the inlet cover 14 and outlet cover 16, being non-structural, may be composed of different materials. Any expansion or loading of rotors 64,66 is partially or wholly accommodated by the bearing inserts 74,76 and the balance pistons 136,138.

The dimensions and shape of the combined outlet port 112 will have a bearing on flow characteristics and may need to be altered to optimise functioning of the compressor 10. These may be altered by replacing the bearing inserts 74,76 with others having differently shaped and/or sized male outlet port 89 and female outlet port 110 combining to form a differently dimensioned and/or shape of the combined outlet port 112.

Although described with particular reference to a screw compressor, it will be understood that the present invention may find utility in other fluid machines, which may include, without limitation, pumps, compressors, turbines and expanders.

By having only one housing the manufacturing process is simplified and misalignments which normally were an issue with three housings are minimised. It is because the inserts have essentially the same diameter as the casing and since both of these are manufactured in one machining operation each it mitigates misalignment.

By the design of bearing inserts which contain bearings and locknuts to locate rotors, substantially all axial forces are contained between the rotor and the insert and are not transmitted to other parts of the machine. That means inserts carry substantially all axial loads whilst the main housing carries substantially just radial loads. Therefore excluding rotors, all other parts of the machine are not subjected to significant loads.

The design of inserts allows subassembly of rotor and insert to be removed from the machine and adjusted externally for appropriate functionality of the machine. This makes the fluid machine flexible and easy to maintain.

Bearing inserts on the inside contain bearings and locking devices to keep rotors in position while on the outside they contain ports which could be flexibly manufactured and changed and do not require any other alterations in the machine to adapt it for different applications.

It has also been found that the hereinbefore described embodiment of the present invention provides appreciable improvements in both volumetric efficiency and reduction in noise over prior art devices.

Moreover, the invention is not limited to its application on screw type machines only, but may find application in all rotary-typeshaft-based designs, including, again without limitation, fan, scroll and centrifugal.

The invention is not limited to the embodiments hereinbefore described, but may modified without departing from the scope of the present invention.

For example, bearing inserts may be provided on both ends of the rotor, replacing or being in addition to the balance pistons.

The invention claimed is:

1. A fluid machine comprising:

at least two rotors including a first rotor and a second rotor, and a rotor drive shaft extending from the first rotor;

a housing in which is mounted the at least two rotors;

a first bearing insert positioned at a first end of the first rotor and mounted around the rotor drive shaft, the first bearing insert comprising at least one first bearing, a first tubular body, and a first attachment flange attached to the housing at a first end of the first tubular body, wherein the first tubular body includes a first flattened portion and a first port adjacent to the first flattened portion; and a second bearing insert positioned at a first end of the second rotor, the second bearing insert comprising at least one second bearing, a second tubular body, and a second attachment flange, the second attachment flange being attached to the housing at a first end of the second tubular body, wherein the second tubular body includes a second flattened portion and a second port adjacent to the second flattened portion, at least a majority portion of the second flattened portion being configured to adjoin together with at least a majority portion of the first flattened portion so as to form an engaged mating relationship therebetween, wherein when the engaged mating relationship occurs, the first port and the second port form a combined port that spans across at least a portion in the first tubular body of the first bearing insert and at least a portion in the second tubular body of the second bearing insert.

2. The fluid machine according to claim 1, wherein the first bearing insert includes a first insert attachment aperture in the first flattened portion, and wherein the second bearing insert includes a second insert attachment aperture in the second flattened portion.

3. The fluid machine according to claim 2, further including a fastener configured to fit in the first insert attachment aperture and the second insert attachment aperture, attaching the first flattened portion of the first bearing insert to the second flattened portion of the second bearing insert.

4. The fluid machine according to claim 1, wherein the at least one first bearing and the at least one second bearing are thrust bearings for balancing axial pressure loads applied to the at least two rotors.

5. The fluid machine according to claim 4, wherein the first bearing insert further includes at least one radial bearing positioned within the first bearing insert.

6. The fluid machine according to claim 1, wherein the first attachment flange and the second attachment flange are configured to attach the first bearing insert and the second bearing insert to the housing by mechanical fasteners.

7. The fluid machine according to claim 1, wherein a further bearing insert is mounted around a second end of the first rotor or the second rotor.

8. The fluid machine according to claim 1, wherein the first bearing insert and the second bearing insert are configured such that substantially all axial forces are contained between the first rotor and the second rotor.

9. A first bearing insert suitable for use with a fluid machine, comprising:

a tubular body having a central bore;

at least one internally mounted bearing with a bearing surface exposed within the central bore;

a flattened portion on a sidewall of the tubular body, the first bearing insert being configured to mate with and face a second bearing insert along the flattened portion of the tubular body, wherein the flattened portion includes a first insert attachment aperture configured to receive a fastener that attaches the first bearing insert to the second bearing insert along the flattened portion of the tubular body; and a first port formed adjacent to the flattened portion of the tubular body, the first port being configured to form a combined port with a second port of the second bearing insert.

10. The first bearing insert according to claim 9, including an attachment flange disposed at a first end of the tubular body.

11. The first bearing insert according to claim 9, wherein the at least one internally mounted bearing includes at least one thrust bearing and at least one radial bearing.

12. A fluid machine comprising:

a housing;

a first rotor mounted in the housing, the first rotor connected to a rotor drive shaft;

a second rotor mounted in the housing;

a first bearing insert coupled to the first rotor, the first bearing insert comprising:

a first attachment flange attached to the housing;

at least one first bearing between the first rotor and the housing;

a first tubular body with a first flattened portion and a first cylindrical portion; and a first port adjacent to the first flattened portion and extending into the first tubular body;

a second bearing insert coupled to the second rotor, the second bearing insert comprising:

a second attachment flange attached to the housing;

at least one second bearing between the second rotor and the housing;

a second tubular body with a second cylindrical portion and a second flattened portion adjoining together with the first flattened portion of the first tubular body so as to form an engaged mating relationship therebetween; and a second port adjacent to the second flattened portion and extending into the second tubular body; and a combined port formed by combining the first port and the second port as the second flattened portion of the second tubular body adjoins together with the first flattened portion of the first tubular body, wherein the combined port spans across at least a portion in the first tubular body of the first bearing insert and at least a portion of the second tubular body in the second bearing insert.

13. The fluid machine according to claim 12, wherein the at least one first bearing includes at least one thrust bearing for balancing axial pressure loads applied to the first rotor.

14. The fluid machine according to claim 13, wherein the at least one second bearing includes at least one thrust bearing for balancing axial pressure loads applied to the second rotor.

15. The fluid machine according to claim 12, wherein the at least one first bearing includes at least one thrust bearing and at least one radial bearing positioned within the first bearing insert.

16. The fluid machine according to claim 15, wherein the at least one second bearing includes at least one thrust bearing and at least one radial bearing positioned within the second bearing insert.

17. The fluid machine according to claim 12, further comprising a third bearing insert mounted around an end of the first rotor or the second rotor.

18. The fluid machine according to claim 12, wherein the first bearing insert and the second bearing insert are configured such that substantially all axial forces are contained between the first rotor and the second rotor.

19. The fluid machine according to claim 12, wherein the first bearing insert includes a first insert attachment aperture in the first flattened portion, and wherein the second bearing insert includes a second insert attachment aperture in the second flattened portion.

20. The fluid machine according to claim 19, further including a fastener configured to fit in the first insert attachment aperture and the second insert attachment aperture, attaching the first flattened portion of the first bearing insert to the second flattened portion of the second bearing insert.

* * * * *